US005098316A

United States Patent [19]

Köllmann et al.

[11] Patent Number: 5,098,316

[45] Date of Patent: Mar. 24, 1992

[54] EQUIPMENT TERMINAL PLUG

[75] Inventors: Hans-Josef Köllmann; Wolfgang Hohorst, both of Minden, Fed. Rep. of Germany

[73] Assignee: Wago Verwaltungsgesellschaft mbH, Minden, Fed. Rep. of Germany

[21] Appl. No.: 648,632

[22] Filed: Jan. 31, 1991

[30] Foreign Application Priority Data

May 2, 1990 [DE] Fed. Rep. of Germany ..... 4003701

[51] Int. Cl.[5] ..... H01R 13/00

[52] U.S. Cl. ..... 439/717; 439/851

[58] Field of Search ..... 439/717, 851, 852, 856, 439/857, 861, 862

[56] References Cited

U.S. PATENT DOCUMENTS 3,358,266 12/1967 Chandler et al. ..... 439/717
3,714,618 1/1973 Appleton ..... 439/717
3,848,951 11/1974 Michaels et al. ..... 439/717

FOREIGN PATENT DOCUMENTS 7423569 7/1974 Fed. Rep. of Germany .
7613119 8/1976 Fed. Rep. of Germany .
2514791 2/1978 Fed. Rep. of Germany .
2700793 7/1978 Fed. Rep. of Germany .
2317040 5/1979 Fed. Rep. of Germany .

*Primary Examiner*—Joseph H. McGlynn
*Attorney, Agent, or Firm*—Salter & Michaelson

[57] ABSTRACT

The invention concerns an equipment terminal plug for wiring electrical equipment with tight space ratios. An extremely compact plug construction is proposed, which has the socket part of a plug connection in addition to the conductor terminal plugs for various electrical conductors per terminal pole, by means of which the equipment terminal plug can be plugged into the electrical apparatus, whereby a high degree of integration of all connections is obtained by special arrangements of the socket part with respect to the conductor terminal plugs.

8 Claims, 2 Drawing Sheets

FIG. 4
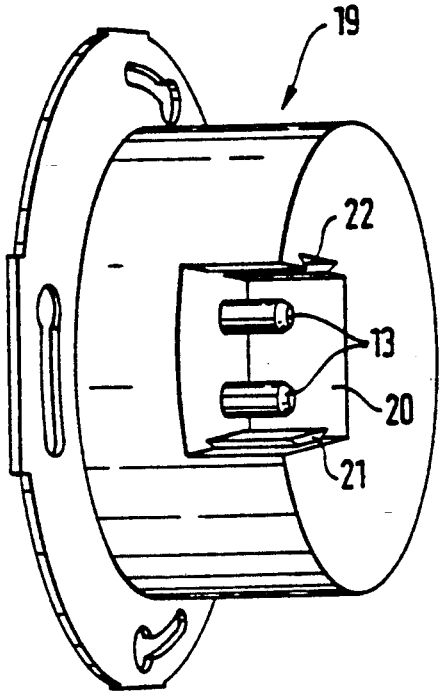
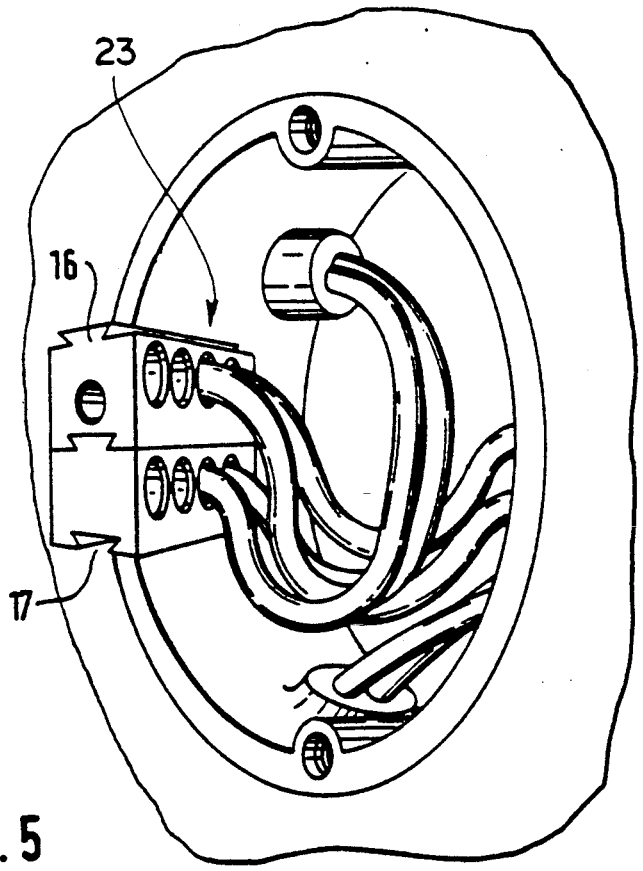
FIG. 5

EQUIPMENT TERMINAL PLUG

BACKGROUND AND SUMMARY OF THE INVENTION

The invention concerns an equipment terminal plug, particularly for wiring electrical equipment with tight space ratios.

In particular, electrical equipment used for control and regulation of technical apparatus is continually becoming smaller and more powerful. Such items are constructed for the most part so small that they can be used, e.g., in household technology in standard flush mountings, surface mounts, and distribution panels, or the like. The invention is concerned with connection of this, and of course, also other electrical equipment, which must be installed with electrical conductors under tight space ratios.

It is the task of the invention to develop an equipment terminal plug, which has two or more clamp-spring conductor terminal plugs per terminal pole, which plugs serve for the screwless connection of two or more electrical conductors, and which have the socket part of a plug connection per pole, for plugging the equipment terminal plug into the electrical apparatus.

It is essential that this task must be resolved for very constricted space ratios.

This task is resolved according to the invention by the fact that the individual conductor terminal plugs of the equipment terminal plug are arranged in series with one another in an aligned row with parallel orientation to each other and all are integrally formed from a one one-piece (one-part) contact application sheet, and that the axial plug direction of the socket part of the equipment terminal plug extends in the series direction of the aligned row of conductor plug terminals, whereby the axial length of the socket part essentially overlaps the series length of the conductor terminal plugs, and that one of the sides of the socket part is formed directly by a formed face of the contact application sheet and that the other side of the socket part is formed by one or more socket contact bows formed from the contact application sheet.

The present invention assure that equipment terminal plugs will be executed in an extremely small construction. The crossing plug directions of the conductor plug connections lying next to each other, on the one hand, and of the socket contact, on the other hand, produce, together with the overlapping arrangement of the socket contact with the otherwise necessary series length of the conductor terminal plugs lying next to one another, an integration action, which makes possible a very compact and small construction of the new equipment plug terminals, despite the number of connecting places that are present.

For this it is also essential that the one-part contact application of the new equipment terminal plug according to the invention has at the same time a formed face, which directly represents one of the sides of the plug connection socket part required according to the task of the invention. The socket part of the plug connection cannot be integrated more closely and compactly in the contact application sheet from which the individual conductor connections are made.

This is particularly clear when more than two, e.g., four conductor connecting plugs are to be executed per terminal pole, e.g., for connecting, looping through, and possible branching of electrical conductors. In this case, the socket part integrated into the equipment terminal plug essentially corresponds to the series length of the conductor terminal plugs arranged next to one another, so that the connection space of the new equipment connecting plugs is utilized to the utmost extent for connection of the diverse electrical conductors as well as also for the arrangement of the plug connection.

A particularly advantageous form of embodiment of the invention provides that the contact application sheet (considered in a cross section transverse to the series direction row of conductor plugs forms an open conductor receiving space that is essentially flat and U-shaped, whose open end lies opposite the open end of a plug leg part essentially formed flat and U-shaped also. The conductor receiving space is thus bent out opposite the plug leg part in a sort of elbow, whereby a type of elbow groove is produced in which the socket part of the plug connection presses in a way that is extremely economical of space.

Another embodiment of the new equipment terminal plug of the invention solves the task of creating a polarity protection for the equipment terminal plugs, which assures for the worker that a polarity mix-up does not occur when connecting the various electrical conductors to the equipment terminal plug as well as during the production of the plug connections for respective electrical equipment adapted to receive the terminal plug.

As a solution, it has been proposed that each terminal pole is accommodated in a separate insulated housing and that the individual pole housings for a 2-pole plug, for example, are composed by the inter-engagement of linear positive connector guides, e.g., dovetail guides, whereby each pole housing has a projecting or male connector guide component on one side and a return or female connector guide component on the other side, and whereby it is important that the positive guides extend in the "plug in" direction of the socket part of the plug connection integrated into the equipment terminal plug, such that the equipment terminal plug composed of individual pole plugs has on its opposite sides different guide components, which provide a polarity protection when the plug connection is inserted, together with the corresponding projecting and return components in the housing of the apparatus unit.

The present form of embodiment of the new equipment terminal plug above all has the advantage that each pole housing of the individual poles can be injection molded in different colors according to injection molding techniques, for example, in the respective colors of the electrical conductors to be connected to the equipment terminal plug. Possible pole mix-ups are then optically visible without anything further.

The positive guides provided for combining the individual pole plugs to a 2-pole or multi-pole apparatus terminal plug are also utilized at the same time for assuring a mechanical terminal protection when plugging in new equipment terminal . plugs to the respective electrical apparatus, together with the corresponding projecting and return components in the housing of the electrical apparatus.

DESCRIPTION OF THE DRAWINGS

An example of embodiment of the invention based on drawings will be more closely described below. Here:

FIG. 4 shows an electrical apparatus, which is to be used in a flush mounting;

FIG. 5 shows a flush mounting with the new equipment terminal plug.

DESCRIPTION OF THE INVENTION

Figure 1:
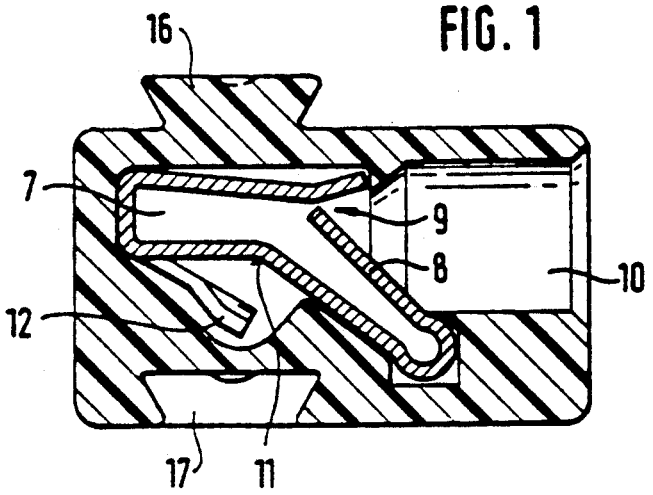
FIG. 1 shows in cross section the new equipment terminal plug.
Figure 2:
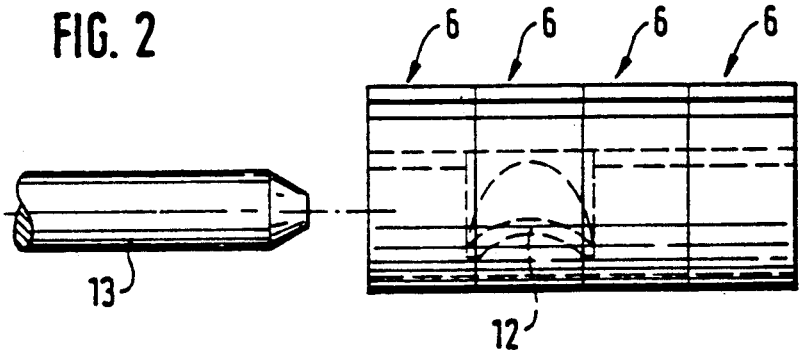
FIG. 2 shows in longitudinal section the contact unit of the equipment terminal plug according to FIG. 1.

FIGS. 1 and 2 show the basic structure of the new equipment terminal plug. In this representation, it has in all four conductor terminal plugs, which in a way known in and of itself, are arranged in series with parallel orientation and are integrally made from a one-piece contact application sheet in the way shown in the cross section according to FIG. 1.

FIG. 1 illustrates that the contact application sheet or conductor terminal plug 6 has an open conductor receiving space 7 which is essentially flat and U-shaped, whose open end lies opposite a plug leg part also formed essentially flat and U-shaped. The plug leg part has a free plug leg 8, which, together with the upper wall of conductor receiving space 7 forms a plug position 9, into which an electrical conductor can be plugged by means of conductor insert openings 10, as shown in FIG. 5.

Conductor receiving space 7 is bent out in a V-shape in an elbow form, opposite the plug leg part which has the plug leg 8, so that a formed face is formed at the contact application sheet in a type of elbow groove 11, and this formed face directly represents one of the sides of the socket part of a plug connection integrated into the equipment terminal plug. The other side of the socket part is given by a socket contact bow 12 formed from the contact application sheet.

FIG. 2 shows that the socket contact bow 12 in cross section has an arched shape which is oriented so that the outer convex surface thereof faces the plug pin 13 of the plug connection, so that the plug pin can be inserted without problem into the socket formed between socket contact bow 12 and the elbow-groove formed face 11 of the contact application sheet and then can be again withdrawn.

FIG. 2 also illustrates that in the equipment terminal plug shown with a total of four conductor terminal plugs 6, the series length is utilized completely of at least 3 conductor terminal plugs in order to accommodate the axial length of plug pin 13 or of the socket part. The socket part and the conductor terminal plugs lying next to each other overlap each other, so that a very compact structural form of the equipment terminal plug is produced.

Figure 3:
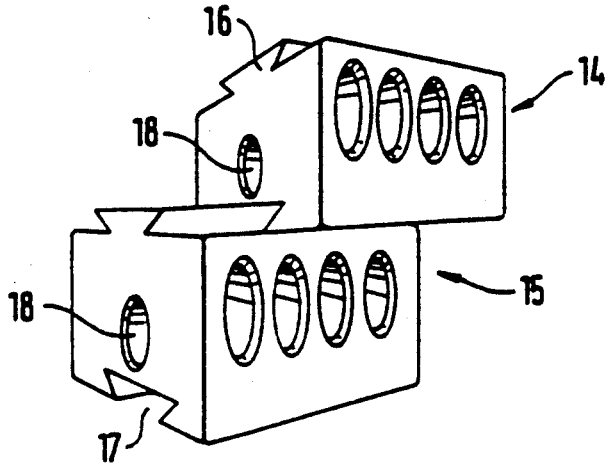
FIG. 3 shows in perspective view an equipment terminal plug which can be made up of individual pole plugs.

FIG. 1 and FIG. 3 show that the equipment terminal plug, as is used hereafter in FIG. 5, consists of two individual pole plugs 14 and 15, which are combined by means of engaging linear dovetail guides 16 and 17.

It is thus important that dovetail guides 16, 17 extend in the "plug in" direction of the socket part, so that they are accessible for guiding the plug part of a plug connection into the plug openings 18 in the insulated housing of the individual pole plugs.

The plug part of the plug connection is provided according to FIG. 4 in the form of an edge recess 20 in the housing of the electrical apparatus 19 and it has stationary plug pins 13, which extend again in the direction of the linear dovetail guides also formed in this edge recess 20 on the equipment side.

The linear dovetail guides 21 and 22 of edge recess 20 on the equipment side correspond therefore to the dovetail guides 16, 17 of the equipment terminal plug, so that the equipment terminal plug 23 shown in FIG. 5 can be plugged into the edge recess 20 on the equipment side without concern to reliability and can be inserted on the plug part on the equipment side of the plug connection.

We claim:

1. In an equipment terminal plug including at least one terminal pole, a plurality of spring clamp conductor terminal plugs to each pole for receiving electrical conductors in electrical contact therein and a socket part for each pole for receiving an electrical apparatus plug pin in electrical contact therein, the improvement comprising the conductor terminal plugs of each pole being disposed in a substantially parallel, conductor terminal plugs, the conductor terminal plugs of each pole being integrally constructed from a onepiece, resilient, conductive contact application sheet, the socket part of each pole having an axial direction extending in the direction of the aligned row thereof and an axial length corresponding to the length of the aligned row thereof, the socket part of each pole having a first side portion which is defined by a formed face integrally formed in the contact application sheet thereof and an opposite second side portion defined by at least one contact row integrally formed in the contact application sheet thereof, the formed face and at least one contact row of each socket part being adapted for resiliently engaging opposite side portions of one electrical apparatus plug pin received therein for electrically connecting the equipment terminal plug thereto.

2. In the equipment plug of claim 1, said contact bow having an arch-shaped, cross sectional configuration and being positioned such that the outer surface of the arch-shaped, cross sectional configuration thereof faces said plug pin when the latter is received in said equipment terminal plug.

3. In the equipment terminal plug of claim 1, the cross sectional configuration of said contact application sheet along a plane which is substantially perpendicular to said axial direction and which intersects said formed face and said contact bows including an open ended conductor receiving portion of substantially flattened, U-shaped configuration and an open ended plug leg portion of open ended, substantially flattened, U-shaped configuration which is positioned so that the open end thereof is opposed to the open end of said conductor receiving portion, said conductor receiving portion and said plug leg receiving portion merging at an angular, outwardly facing elbow groove, said elbow groove defining said formed face.

4. The equipment terminal plug of claim 3, including a plurality of said poles and further comprising an insulated housing for each pole, each of said insulated housings having opposite sides and having a linear male connector guide on one side thereof and a linear female connector guide on the opposite side thereof, said connector guides being substantially parallel to the respective rows thereof, the male and female connector guides of adjacent pole housings being received in engagement for connecting the adjacent pole housings together such that a free male connector guide faces outwardly form one side of said conductor terminal plug and a free female connector guide faces outwardly from an opposite second side of said conductor terminal plug for receiving female and male connector guides, respectively, of a housing of a multi-pin electrical apparatus plug in order to maintain said equipment terminal plug in a predetermined orientation relative to said multi-pin electrical apparatus plug.

5. In the equipment terminal plug of claim 4, said male and female connector guides comprising male and female dovetail components, respectively.

6. In the equipment terminal plug of claim 4, the female connector guide of each housing being disposed adjacent the socket part of the plug connection thereof and facing the elbow groove of the contact application sheet thereof.

7. The equipment terminal plug of claim 3, including a plurality of said poles and further comprising an insulated housing for each pole, each of said insulated housings having opposite sides and having a linear male connector guide on one side thereof and a linear female connector guide on the opposite side thereof, said connector guides being substantially parallel to the respective rows thereof, the male and female connector guides of adjacent pole housings being received in engagement for connecting the adjacent pole housings together such that a free male connector guide faces outwardly form one side of said conductor terminal plug and a free female connector guide faces outwardly from an opposite second side of said conductor terminal plug for receiving female and male connector guides, respectively, of a housing of a multi-pin electrical apparatus plug in order to maintain said equipment terminal plug in a predetermined orientation relative to said multi-pin electrical apparatus plug.

8. In the equipment terminal plug of claim 7, said male and female connector guides comprising male and female dovetail components, respectively.

* * * * *